DOLLY EQUIPPED WITH LOADING-UNLOADING SCISSOR HOIST

SUMMARY OF THE INVENTION

The primary object of the present invention is to provide a means for hoisting a heavy object from the floor or the ground and loading it onto the platform of a dolly or trailer or flat car.

Another object of the present invention is to provide said hoisting and loading means which is integrally incorporated into the construction of the dolly or trailer or flat car.

A further object of the present invention is to provide said hoisting and loading means that is compact and simple in the construction and operation.

Still another object of the present invention is to provide a mobile hoist means for lifting the heavy objects in the field.

Still a further object of the present invention is to provide a hoist means that relies directly on the scissor movement between two structural frames coupled to one another in a pivoting relationship.

These and other objects of the present invention will become clear as the description of the present invention proceeds. The present invention may be described with a great clarity and specificity by referring to the following figures.

Figure 1:
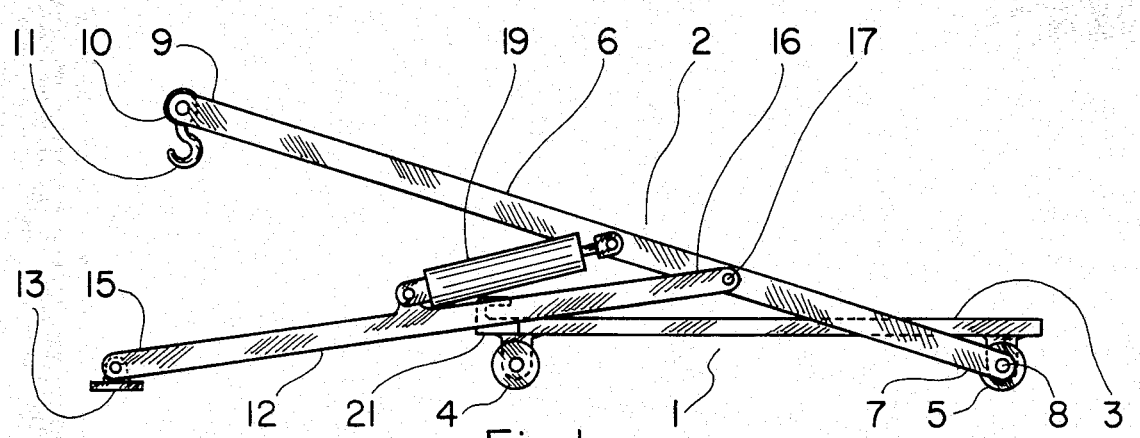
FIG. 1 illustrates an elevation view of a scissor hoist incorporated into the construction of a dolly or trailer or flat car.

In FIG. 1, there is shown an elevation view of a dolly 1 equipped with a scissor hoist 2, which combination is constructed in accordance with the principles of the present invention. The dolly 1 equipped with a scissor hoist comprises a platform or dolly frame 3 including four wheels 4,5, etc. The scissor hoist comprises a first frame 6 including a first long elongated member and a second long elongated member rigidly connected to one another by a cross member. The openextremity 7 of the first frame 6 is pivotably connected to the platform or dolly frame 3 near the first and second corners of the platform or dolly frame wherein the first frame 6 is pivotable about a first common pivoting axis. In the particular embodiment shown in FIG. 1, the first common pivoting axis coincides with the axis of the axle 8 rotatably supporting the wheels 5, etc. The closed-extremity 9 of the first frame 6 includes a cross member 10 rigidly affixed to the first and second long elongated members, wherein the means 11 such as a hook for securing an object to be hoisted depends from the cross member 10. The scissor hoist 2 further includes a second frame 12 comprising a first short elongated member and a second short elongated member. One extremity of the first short elongated member is pivotably connected to the first long elongated member intermediate one extremity pivotably connected to the platform or dolly frame and the other extremity rigidly connected to the cross member, while the other extremity of the first short elongated member includes a foot plate 13 pivotably connected thereto. One extremity of the second short elongated member is pivotably connected to the second long elongated member intermediate one extremity pivotably connected to the platform or dolly frame and the other extremity rigidly connected to the cross member, while the other extremity of the second short eleongated member includes a foot 14 pivotably connected thereto. The one extremity 16 of the second frame 12 included in the scissor hoist is pivotable about a second common pivoting axis substantially parallel to the first common pivoting axis, while the other extremity 15 of the second frame 12 including a pair of foot plates 13 and 14 rests on a floor or the ground. The hinge joints 17 and 18 pivotably connecting the first frame 6 and the second frame 12 defines the second common pivoting axis in the scissor movement of the first frame 6 and the second frame 12 about the second common pivoting axis. The scissor hoist 2 includes a pair of linear actuators 19 and 20 wherein one extremity of each of the two linear actuators 19 and 20 is pivotably anchored to the first and second long elongated members included in the first frame, respectively, and the other extremity of each of the two linear actuators 19 and 20 is pivotably anchored to the first and second short elongated members included in the second frame 12. The action of the two linear actuators 19 and 20 provides the scissor movement of the first frame 6 and the second frame 12 about the second common pivoting axis defined by the central axis of the hinge joints 17 and 19. The dolly 1 includes the means 21 for removally anchoring the foot plates 13 and 14, which is used to stow away the scissor hoist 2 in a position where the cross member included in the first frame of the scissor hoist serves as a handle for the dolly.

Figure 2:
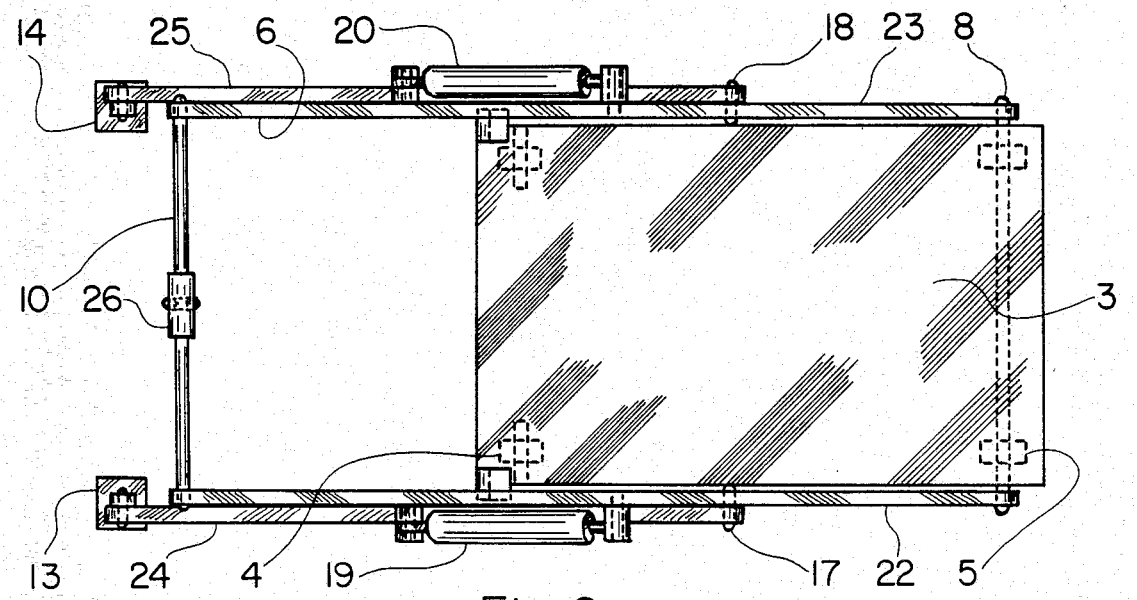
FIG. 2 illustrates the plan view of the scissor hoist incorporated into the construction of a dolly or trailer or flat car as shown in FIG. 1.
Figure 3:
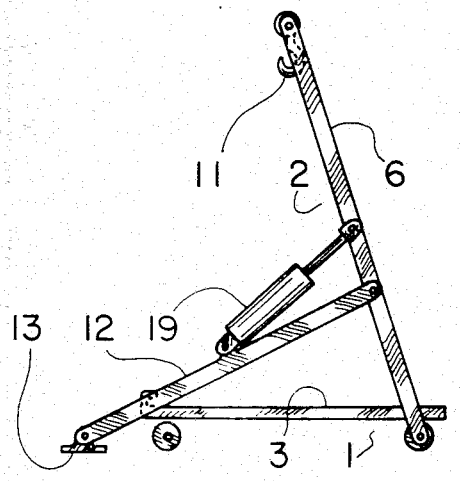
FIG. 3 illustrates the scissor hoist shown in FIGS. 1 and 2 which is at the maximum hoisted position.
Figure 4:
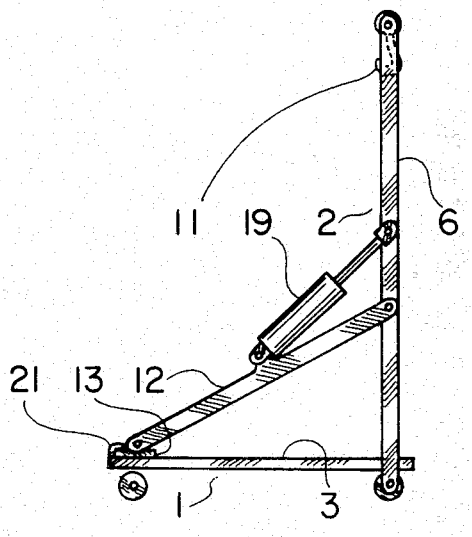
FIG. 4 illustrates the scissor hoist shown in FIGS. 1 and 2 that is at the stowed-away position wherein it is used as the handle of the dolly.
Figure 5:
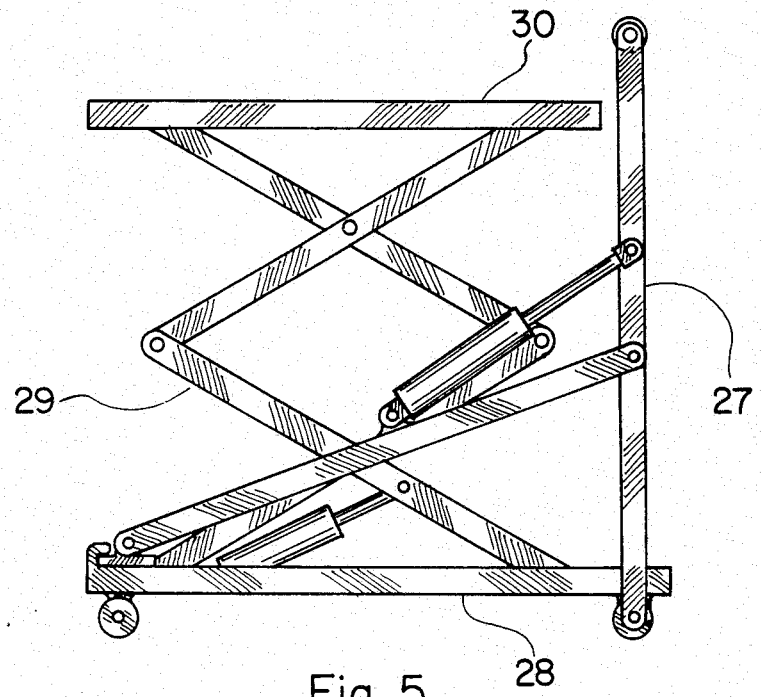
FIG. 5 illustrates the scissor hoist of the same construction and function as that of FIGS. 1 and 2 incorporated into the construction of a dolly having a platform equiped with a scissor lift.
Figure 6:
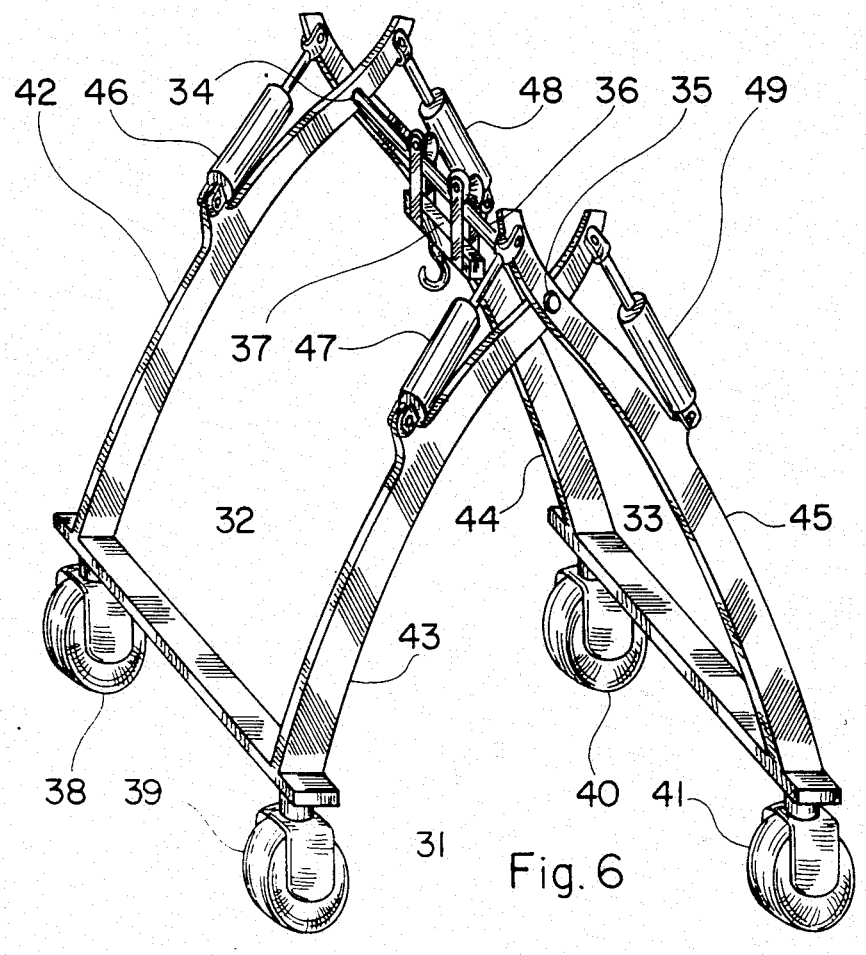
FIG. 6 illustrates another scissor lift for hoisting the heavy objects in the field that can be used as a transporting vehicle as well.

In FIG. 2 there is shown a plan view of the scissor hoist 2 incorporated into the construction of the dolly 1 as shown in FIG. 1. The first frame 6 included in the scissor hoist 2 comprises a a first and a second long elongated members 22 and 23 rigidly connected to one another by the cross member 10 at their upper extremities, while their lower extremities are pivotably anchored to the axle 8 rigidly secured to the platform or dolly frame 3 of the dolly 1. The cross member 10 supports slidably or affixedly the element 26 from which the hoist cable or chain with the hook 11 depends. The second frame 12 comprises a pair of a first and a second short elongated members 24 and 25 including the foot plates 13 and 14 at their lower extremities, which foot plates are pivotably connected to the lower extremities of the short elongated members 24 and 25, respectively. The upper extremities of the short elongated members 24 and 25 are pivotably connected to the long elongated members 22 and 23 included in the first frame 6 by means of the hinge joints 17 and 18 disposed intermediate the upper and lower extremities of the long elongated members 22 and 23. The pair of the linear actuators 19 and 20 with one extremities pivotably anchored to the pair of the long elongated members included in the first frame 6 and the other extremities pivotably anchored to the pair of the short elongated members gated members are pivotably about a first common pivoting axis;

(3) a cross member rigidly connected to the other extremity of said first long elongated member opposite to said one extremity and connected to the other extremity of said second long elongated member opposite to said one extremity, said cross member including means for securing an object to be hoisted by said scissor hoist;

(4) a first short elongated member with one extremity pivotably connected to said first long elongated member intermediate said one and the other extremity of said first long elongated member wherein said first short elongated member is pivotable about second common pivoting axis, said first short elongated member including a foot plate connected to the other extremity of said first short elongated member in a hinged relationship;

(5) a second short elongated member disposed substantially parallel to said first short elongated member with one extremity pivotably connected to said second long elongated member intermediate said one and the other extremity of said second long elongated member wherein said second short elongated member is pivotable about said second common pivoting axis, said second short elongated member including a foot plate connected to the other extremity of said second short elongated member in a hinged relationship;

(6) a first linear actuator providing a scissor movement of said first long elongated member and said first short elongated member substantially straddling said platform about said second common pivoting axis;

(7) a second linear actuator providing a scissor movement of said second long elongated member and said second short elongated member substantially straddling said platform about said second common pivoting axis; and (8) a first means disposed near a third corner of said platform diagonally opposite to said second corner for removably anchoring said the other extremity of said first short elongated member, and a second means disposed near a fourth corner of said platform diagonally opposite to said first corner for removably anchoring said the other extremity of said second short elongated member;

whereby, when said foot plates respectively connected to said the other extremities of said first and second short elongated members are placed on a floor or the ground, said scissor hoist is usable for hoisting an object from the floor or the ground in loading and for hoisting an object from said platform in unloading, and when said the other extremities of said first and second short elongated members are respectively anchored to said first and second means for removably anchoring, said cross member affixed to said first and second long elongated members is usable as a handle of said dolly.

2. A dolly equipped with a loading-unloading scissor hoist comprising in combination:

(a) a dolly frame of rectangular shape including a plurality of wheels rollable on a floor or the ground;

(b) a scissor hoist including;

(1) a first long elongated member with one extremity pivotably connected to said dolly frame near a first corner of said dolly frame;

(2) a second long elongated member disposed substantially parallel to said first long elongated member with one extremity pivotably connected to said dolly frame near a second corner of said dolly frame wherein said first and second long elongated members are pivotable about a first common pivoting axis;

(3) a cross member rigidly connected to the other extremity of said first long elongated member opposite to said one extremity and connected to the other extremity of said second long elongated member opposite to said one extremity, said cross member including means for securing an object to be hoisted by said scissor hoist;

(4) a first short elongated member with one extremity pivotably connected to said first long elongated member intermediate said one and the other extremity of said first long elongated member wherein said first short elongated member is pivotable about second common pivoting axis, said first short elongated member including a foot plate connected to the other extremity of said first short elongated member in a hinged relationship;

(5) a second short elongated member disposed substantially parallel to said first short elongated member with one extremity pivotably connected to said second long elongated member intermediate said one and the other extremity of said second long elongated member wherein said second short elongated member is pivotable about said second common pivoting axis, said second short elongated member including a foot plate connected to the other extremity of said second short elongated member in a hinged relationship;

(6) a first linear actuator providing a scissor movement of said first long elongated member and said first short elongated member substantially straddling said dolly frame about said second common pivoting axis;

(7) a second linear actuator providing a scissor movement of said second long elongated member and said second short elongated member substantially straddling said dolly frame about said second common pivoting axis;

(8) a first means disposed near a third corner of said dolly frame diagonally opposite to said second corner for removably anchoring said the other extremity of said first short elongated member, and a second means disposed near a fourth corner of said dolly frame diagonally opposite to said first corner for removably anchoring said the other extremity of said second short elongated member; and (9) a platform equipped with a scissor lift and disposed on top of said dolly frame wherein said platform is raised and lowered by a scissor action of said scissor lift;

whereby, when said foot plates respectively connected to said the other extremities of said first and second short elongated members are placed on a floor or the ground, said scissor hoist is usable for hoisting an object from the floor or the ground in loading and for hoisting an object from a dolly platform in unloading, and when said the other extremeties of said first and second short elongated members are respectively anchored to said first and second means for removably anchoring, said cross member affixed to said first and second long elongated members is usable as a handle of said dolly.

* * * * *

United States Patent [19]

Jussila

[11] Patent Number: 4,503,984

[45] Date of Patent: Mar. 12, 1985

[54] TELFER CARRIAGE

[75] Inventor: Olavi Jussila, Hyvinkää, Finland

[73] Assignee: Kone Oy, Helsinki, Finland

[21] Appl. No.: 440,725

[22] Filed: Nov. 10, 1982

[51] Int. Cl.[3] ..... B66C 17/00

[52] U.S. Cl. ..... 212/205; 105/163 R

[58] Field of Search ..... 212/124–139, 212/146, 147, 205–221; 104/98; 105/163 R, 163 SK

[56] References Cited

U.S. PATENT DOCUMENTS 400,143 3/1889 Taylor ..... 212/205

481,964 9/1892 Morgan ..... 105/163 R 3,891,094 6/1975 Angus ..... 212/205

*Primary Examiner*—Trygve M. Blix

*Assistant Examiner*—Stephen P. Avila

*Attorney, Agent, or Firm*—Martin Smolowitz

[57] ABSTRACT

The invention concerns a telfer carriage comprising dual end supports a supporting beam, hoisting and displacing machinery and a rope drum. To the end supports has been pivotally affixed the supporting beam lying immediately beside the rope drum and parallel therewith. The end supports have been rigidly joined together by a non-rotating axle, on which are furthermore rotatably carried, the rope drum and a carrying wheel pair.

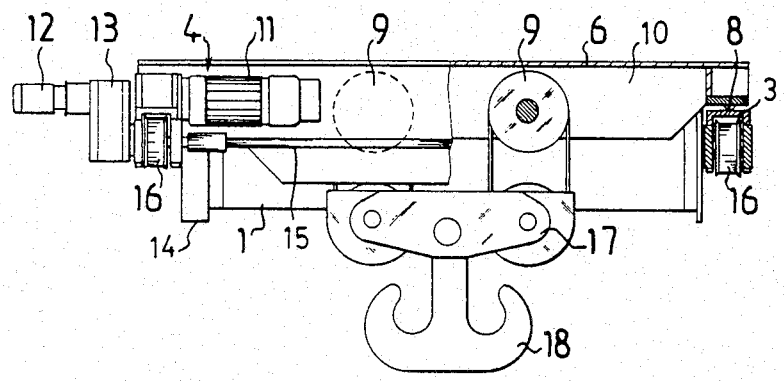

6 Claims, 3 Drawing Figures